US010123561B2

(12) United States Patent
Kadiric

(10) Patent No.: US 10,123,561 B2
(45) Date of Patent: Nov. 13, 2018

(54) METHOD OF FORMING SMOKING ARTICLES WITH MOUTH END CAVITIES

(71) Applicant: PHILIP MORRIS PRODUCTS S.A., Neuchatel (CH)

(72) Inventor: Alen Kadiric, Biel (CH)

(73) Assignee: Philip Morris Products S.A., Neuchatel (CH)

( * ) Notice: Subject to any disclaimer, the term of this patent is extended or adjusted under 35 U.S.C. 154(b) by 321 days.

(21) Appl. No.: 14/417,450

(22) PCT Filed: Jul. 19, 2013

(86) PCT No.: PCT/EP2013/065330

§ 371 (c)(1),
(2) Date: Jan. 26, 2015

(87) PCT Pub. No.: WO2014/023555

PCT Pub. Date: Feb. 13, 2014

(65) Prior Publication Data

US 2015/0208720 A1 Jul. 30, 2015

(30) Foreign Application Priority Data

Aug. 6, 2012 (EP) ..... 12179441

(51) Int. Cl.
*A24D 3/06* (2006.01)
*A24C 5/47* (2006.01)
(Continued)

(52) U.S. Cl.
CPC ..... *A24C 5/47* (2013.01); *A24C 5/005* (2013.01); *A24C 5/476* (2013.01); *A24D 1/02* (2013.01);
(Continued)

(58) Field of Classification Search
CPC ..... A24D 3/04
See application file for complete search history.

(56) References Cited

U.S. PATENT DOCUMENTS 2,820,462 A * 1/1958 Fleischer ..... A24D 1/047 131/187
2,920,631 A * 1/1960 Korber ..... A24C 5/476 131/94
(Continued)

FOREIGN PATENT DOCUMENTS

CN 101500442 8/2009
CN 101578053 11/2009
(Continued)

OTHER PUBLICATIONS

Extended European Search Report for Application No. 12179441.6-1656 dated Feb. 27, 2013 (6 pages).
(Continued)

*Primary Examiner* — Eric Yaary
(74) *Attorney, Agent, or Firm* — Mueting, Raasch & Gebhardt, P.A.

(57) ABSTRACT

A method of producing smoking articles, the method comprising a first step of providing a continuous array of first filter members (42), second filter segments (20) and tubular members (40). A tubular member (40) is provided between each pair of consecutive first filter members (42) and a second filter segment (20) is provided between each first filter member (42) and each tubular member (40). Each second filter segment (20) contains one or more breakable capsules, wherein each breakable capsule comprises an outer shell and an inner core containing an additive. The continuous array of first filter members (42), second filter segments (20) and tubular members (40) is then wrapped with a continuous sheet of plug wrap (44) to form a wrapped
(Continued)

filter array, wherein the plug wrap (44) has a basis weight of less than 90 grams per square meter. The wrapped filter array is cut at an intermediate position along each first filter member (42) to provide multiple filter rods, each filter rod comprising two first filter segments (18), a tubular member (40) positioned between the first filter segments (18) and a second filter segment (20) provided between each first filter segment (18) and the tubular member (40). Next, a tobacco rod (12) is provided in axial alignment with and adjacent to each first filter segment (18) of one of the filter rods, and the filter rod and a portion of each tobacco rod (12) are wrapped in a tipping wrapper (50). Finally, the tipping wrapper (50) and the filter rod are cut at an intermediate position along the length of the tubular member (40) to form multiple smoking articles (10), each smoking article (10) comprising a tobacco rod (12) connected to a filter (14), wherein each filter (14) comprises a first filter segment (18) downstream of the tobacco rod (12), a second filter segment (20) downstream of the first filter segment (18), and a hollow tube segment (22) positioned between the second filter segment (20) and the mouth end of the filter (14). The hollow tube segment (22) defines a cavity (24) at the mouth end of the filter (14).

8 Claims, 3 Drawing Sheets

(51) Int. Cl.

| | |
|---|---|
| ***A24D 1/02*** | (2006.01) |
| ***A24D 3/02*** | (2006.01) |
| ***A24D 3/04*** | (2006.01) |
| ***A24C 5/00*** | (2006.01) |
| ***A24D 1/04*** | (2006.01) |

(52) U.S. Cl.
CPC ..... *A24D 1/045* (2013.01); *A24D 3/0291* (2013.01); *A24D 3/04* (2013.01); *A24D 3/048* (2013.01); *A24D 3/061* (2013.01)

(56) References Cited

U.S. PATENT DOCUMENTS

| | | | | |
|---|---|---|---|---|
| 2,979,058 | A | 4/1961 | Schur | |
| 3,308,833 | A | 3/1967 | Dearsley | |
| 7,243,659 | B1 | 7/2007 | Lecoultre | |
| 7,699,061 | B2 | 4/2010 | Seitert | |
| 7,793,665 | B2 | 9/2010 | Dube | |
| 8,079,369 | B2 | 12/2011 | Andresen | |
| 2004/0097354 | A1 | 5/2004 | Yamashita | |
| 2007/0012327 | A1* | 1/2007 | Karles | A24D 3/0216 131/337 |
| 2008/0142028 | A1 | 6/2008 | Fagg | |
| 2008/0230079 | A1 | 9/2008 | Besso | |
| 2008/0302376 | A1 | 12/2008 | Karles | |
| 2009/0044817 | A1 | 2/2009 | Besso | |
| 2010/0108085 | A1* | 5/2010 | Duke | A24D 3/04 131/339 |
| 2011/0271968 | A1* | 11/2011 | Carpenter | A24D 3/048 131/275 |
| 2012/0325232 | A1* | 12/2012 | Yokogawa | A24D 3/061 131/337 |
| 2013/0047999 | A1* | 2/2013 | Rushforth | A24D 3/068 131/332 |
| 2013/0167849 | A1* | 7/2013 | Ademe | A24C 5/472 131/94 |
| 2013/0167851 | A1* | 7/2013 | Ademe | A24D 3/048 131/280 |
| 2013/0247924 | A1* | 9/2013 | Scatterday | A61M 15/06 131/329 |

FOREIGN PATENT DOCUMENTS

| | | | |
|---|---|---|---|
| CN | 101790329 | 7/2010 | |
| CN | 101808541 | 8/2010 | |
| EP | 2578093 | 4/2013 | |
| GB | 862 676 | 3/1961 | |
| GB | 2159386 | 5/1988 | |
| GB | 2210546 | 6/1989 | |
| JP | H08-322538 | 12/1996 | |
| JP | 2004-516814 | 6/2004 | |
| JP | WO 2011118001 A1 * | 9/2011 | A24D 3/061 |
| RU | 2264766 | 11/2005 | |
| SU | 1414309 | 7/1988 | |
| WO | WO 00/60962 | 10/2000 | |
| WO | WO 2002/003819 | 1/2002 | |
| WO | WO 2007/110650 | 10/2007 | |
| WO | WO 2011/077141 | 6/2011 | |
| WO | WO 2011/152316 | 12/2011 | |
| WO | WO 2012/016641 | 2/2012 | |

OTHER PUBLICATIONS

Office Action issued in China for Application No. 201380041776.1 dated Aug. 18, 2016 (18 pages). English translation included.
PCT Search Report and Written Opinion for PCT/EP2013/065330 dated Jan. 20, 2014 (11 pages).
Office Action issued in Japan for Application No. 2015-525805 dated Apr. 12, 2017 (8 pages). English translation included.
Office Action issued in Taiwan for Application No. 102127436 dated Aug. 8, 2017 (14 pages). English translation included.
Office Action issued in Mexico for Application No. MX/A/15/001725 dated Jul. 27, 2017 (10 pages). English translation included.
Office Action issued in Russia for Application No. 2015107782 dated Jun. 29, 2017 (11 pages). English translation included.
Office Action issued in Japan for Application No. 2015-525805 dated Feb. 7, 2018 (4 pages). English translation included.
Notice of Allowance issued in Ukraine for Application No. 201501120 dated Nov. 21, 2017 (12 pages). English translation included.

* cited by examiner

METHOD OF FORMING SMOKING ARTICLES WITH MOUTH END CAVITIES

This application is a U.S. National Stage Application of International Application No. PCT/EP2013/065330, filed Jul. 19, 2013, which was published in English on Feb. 13, 2014 as International Patent Publication WO 2014/023555 A1. International Application No. PCT/EP2013/065330 claims priority to European Application No. 12179441.6, filed Aug. 6, 2012.

The present invention relates to a method of forming smoking articles each having a mouth end cavity formed by a hollow tube segment.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the smoking article. As the released compounds cool they condense to form an aerosol that is inhaled by the consumer. Smoking articles in which a nicotine-containing aerosol is generated from a tobacco material, tobacco extract or other nicotine source, without combustion or heating, are also known.

Sometimes it is desirable to provide the filter section of a smoking article with a cavity at the mouth end. However, such mouth end cavities are prone to collapse or deformation during manufacture of the smoking article and during subsequent handling by the consumer, particularly when the filtration material includes one or more flavour containing materials which must be activated by squeezing the filter prior to smoking.

It would therefore be desirable to provide a process for forming smoking articles having mouth end cavities, wherein the cavities are resistant to deformation and collapse during manufacture and subsequent handling of the smoking article.

Accordingly, the present invention provides a method of producing smoking articles, the method comprising a first step of providing a continuous array of first filter members, second filter segments and tubular members. A tubular member is provided between each pair of consecutive first filter members and a second filter segment is provided between each first filter member and each tubular member. Each second filter segment contains one or more breakable capsules, wherein each breakable capsule comprises an outer shell and an inner core containing an additive. The continuous array of first filter members, second filter segments and tubular members is then wrapped with a continuous sheet of plug wrap to form a wrapped filter array, wherein the plug wrap has a basis weight of less than 90 grams per square meter. The wrapped filter array is cut at an intermediate position along each first filter member to provide multiple filter rods, each filter rod comprising two first filter segments, a tubular member positioned between the first filter segments and a second filter segment provided between each first filter segment and the tubular member. Next, a tobacco rod is provided in axial alignment with and adjacent to each first filter segment of one of the filter rods, and the filter rod and a portion of each tobacco rod are wrapped in a tipping wrapper. Finally, the tipping wrapper and the filter rod are cut at an intermediate position along the length of the tubular member to form multiple smoking articles, each smoking article comprising a tobacco rod connected to a filter, wherein each filter comprises a first filter segment downstream of the tobacco rod, a second filter segment downstream of the first filter segment, and a hollow tube segment positioned between the second filter segment and the mouth end of the filter. The hollow tube segment defines a cavity at the mouth end of the filter.

Preferably, the hollow tube segment extends from the downstream end of the adjacent filter segment to the mouth end edge of the filter.

As used herein, the terms "upstream" and "downstream" are used to describe the relative positions of elements, or portions of elements, of a smoking article in relation to the direction in which a user draws on the smoking article during use thereof. Smoking articles as described herein comprise a downstream end and an opposed upstream end. In use, a user draws on the downstream end of the smoking article. The downstream end, which is also described as the mouth end, is downstream of the upstream end, which may also be described as the distal end.

By utilising tubular members in the filter rods, the method according to the present invention advantageously produces smoking articles each having a mouth end cavity which is resistant to collapse or deformation during manufacture. In particular, the tubular members provide sufficient mechanical rigidity to resist deformation during cutting of the wrapped filter array to form each filter rod and during cutting of the tubular members to form the smoking articles. By providing such a resistance to deformation with tubular members, the present invention eliminates the need to use stiff, high basis weight plug wraps and tipping wrappers which might otherwise be required to prevent collapse of cavities. Such high basis weight plug wraps and tipping wrappers are undesirable since they can become creased or folded during manufacture of the filter rods and the smoking articles. High basis weight plug wraps and tipping wrappers can also add other costly steps to the manufacturing process, such as the need for online laser perforation ventilation. Furthermore, high basis weight plug wraps and tipping wrappers can make it difficult for a consumer to deform the filter in order to break the one or more capsules contained therein. By eliminating the need for such high basis weight plug wraps and tipping wrappers and by forming the mouth end cavity using a hollow tube segment, smoking articles produced in accordance with the present invention allow a consumer to easily deform the filter at the second filter segment in order to break the one or more capsules contained therein, whilst ensuring the mouth end cavity is sufficiently resistant to deformation or collapse.

The continuous sheet of plug wrap used has a basis weight of less than about 90 gsm, preferably less than about 60 gsm, most preferably less than about 40 gsm. The plug wrap preferably has a basis weight of more than about 20 gsm.

In some embodiments, it may be desirable to include further segments of filtration material in each smoking article. Advantageously, the method according to the present invention can be adapted easily to accommodate such multiple segment filter rods by inserting the required number of additional filter segments between each first filter member and each tubular member. Regardless of the number of different filter segments used to form the wrapped filter array, the filter segments adjacent to each end of each tubular member are preferably the same, that is they preferably have the same composition.

The filtration material within each filter segment is preferably a plug of fibrous filtration material, such as cellulose acetate tow or paper. A filter plasticiser may be applied to the fibrous filtration material in a conventional manner, by spraying it onto the separated fibres, preferably before applying any additional material to the filtration material. Smoking articles made in accordance with the present invention may include a variety of different types of filter segments or combinations of filter segments that would be known to the skilled person, including restrictors and segments that are used for adjusting the resistance to draw (RTD). Alternatively, or in addition, smoking articles made in accordance with the present invention may include one or more segments containing carbon, preferably a rod end segment containing carbon.

In some cases, it may be desirable to provide the filter with means for releasing a flavourant or other additive on demand, usually via manual release by the consumer immediately prior to smoking the smoking article. Therefore, the method may further comprise a step of providing a flavorant containing material in a filter segment of the filter. The flavourant containing material may be added to the first filter segment. Additionally, or alternatively, the flavourant containing material may be added to the second filter segment.

In some embodiments, the flavourant containing material comprises the one or more breakable capsules contained within the second filter segment. Preferably, the second filter segment comprises the one or more breakable capsules dispersed within a fibrous filtration material.

In embodiments comprising a flavourant containing material, a filter segment incorporating the flavor containing material is preferably circumscribed by a plug wrap that is substantially impermeable to the flavourant additive. This advantageously inhibits transfer of the additive through the plug wrap to the outside of the filter, where it may undesirably come into contact with the consumer's fingers when the filter is incorporated into a smoking article.

To further improve the resistance of each tubular member to deformation during manufacture of the filter rods and the smoking articles, the wall of each tubular member preferably has a thickness of at least about 100 micrometers, more preferably at least about 150 micrometers. Alternatively, or in addition, the wall thickness is preferably less than about 500 micrometers, more preferably less than about 350 micrometers, most preferably less than about 250 micrometers.

Preferably, each tubular member has a length of at least about 4 mm. This not only provides a mouth end cavity of an appropriate size, but also ensures sufficient overlap between the tubular member and the plug wrap to maintain the tubular member in axial alignment with the adjacent filter segment. Additionally, or alternatively, each tubular member preferably has a length of less than about 30 mm.

In some embodiments, each tubular member may comprise a coating layer on an inner surface thereof. A coating layer can help to inhibit absorption of moisture into the tubular member during smoking of the smoking article, therefore maintaining the resistance of the mouth end cavity to deformation. Suitable coating materials include, but are not limited to, waxes, polymeric materials and combinations thereof. Particularly suitable waxes include vegetable waxes, and other particularly suitable materials are ethylcellulose and nitrocellulose.

In some embodiments, the tubular members may be formed from a polymeric material or a paper material. For example, the tubular members can be formed from extruded plastic tubes. Preferably, the tubular members are formed from a plurality of overlapping paper layers, such as a plurality of parallel wound paper layers or a plurality of spirally wound paper layers, which can further increase the resistance of the tubular members to deformation or collapse. Preferably each tubular member comprises at least two paper layers. Alternatively, or additionally, each tubular member preferably comprises fewer than eleven paper layers.

An exemplary method for forming a tubular member from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required tubular members downstream of the mandrel.

To inhibit the transfer of moisture from one paper layer to the next during smoking of the smoking article, adjacent paper layers of each tubular member are preferably adhered together by an intermediate layer of adhesive, which provides a barrier to the transfer of moisture between layers. This may be in addition to or as an alternative to a coating provided on an inner surface of each tubular member, as described above. Such a coating may additionally, or alternatively, be provided between adjacent layers of the tubular member.

The first cutting step comprises cutting the wrapped filter array at an intermediate position along the length of each first filter member such that each filter rod comprises a single tubular member positioned between the two first filter segments. Each filter rod is used to produce two smoking article filters by cutting the filter rod at an intermediate position along the length of the tubular member. Therefore, these filter rods may be known as dual filter rods.

The dual filter rods can be formed directly from the wrapped filter array by cutting consecutive first filter members. Alternatively, the cutting step may comprise a first step of cutting the wrapped filter array at an intermediate position along the length of every other first filter member (that is, cutting a first filter member, not cutting the next first filter member, cutting the following first filter member, not cutting the next filter member, and so on) to form filter rods each comprising two tubular members positioned between two first filter segments and a single first filter member positioned between the two tubular members. Such filter rods may be known as quadruple filter rods. To form the smoking articles, the quadruple filter rods are cut at an intermediate position along the length of the first filter member to form two dual filter rods, and the two dual filter rods are used to form four smoking articles.

Smoking articles formed in accordance with the methods described above may exhibit a difference between the ovality of the tube segment after a 50% deformation of the filter and the ovality of the tube segment prior to deformation of the filter of less than about 25%, preferably less than about 20%. For example, where the ovality of the tube segment prior to deformation is 5%, the ovality of the tube segment after a 50% deformation of the filter is preferably less than 30%, more preferably less than 25%. The tube segment therefore provides a mouth end cavity which is resistant to collapse or deformation. The particular test procedure for conducting deformations of the filter in accordance with present invention is described in detail below.

The term "ovality" as used herein means the degree of deviation from a perfect circle. Ovality is expressed as a percentage and the mathematical definition is given below.

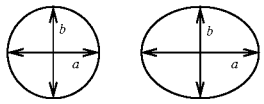

Circular shape $a = b$ Oval shape $a \neq b$ $$\text{ovality (\%)} = \frac{2(a - b)}{a + b} \times 100\%$$

To determine the ovality of a segment of a smoking article (such as the hollow tube segment), the mouth end is viewed along the longitudinal direction of the smoking article. For example, the smoking article can be positioned on its mouth end on a transparent stage so that an image of the mouth end of the article is recorded by a suitable imaging device located below the stage. Dimension "a" is taken to be the largest external diameter of the segment at its downstream end, and dimension "b" is taken to be the smallest external diameter of the segment at its downstream end. The process is repeated for a total of ten smoking articles having the same design and the number average of the ten ovality measurements is recorded as the ovality for that design of smoking article.

Since smoking article filters are generally circular in cross section, the ovality of the hollow tube segment after a 50% deformation is preferably less than about 25%, more preferably less than about 20%. In this case, the mouth end cavity of the smoking article retains or resumes a generally circular cross section, even after a 50% deformation of the filter. Alternatively, or in addition, the ovality of the tube segment after a 67% deformation of the filter is preferably less than about 35%, more preferably less than about 30%.

In some embodiments, the ovality of the hollow tube segment after a 50% deformation of the filter performed after the smoking article has been subjected to a smoking test is preferably less than about 35%, more preferably less than about 30%. Alternatively, or in addition, the ovality of the tube segment after a 67% deformation of the filter performed after the smoking article has been subjected to a smoking test is preferably less than about 45%, more preferably less than about 40%. This advantageously provides consistency in the ovality of the mouth end cavity during smoking of the smoking article.

The smoking test used for testing smoking articles in accordance with the present invention is described in detail below. Where it is necessary to measure the ovality after deformation tests performed both before and after smoking, two samples of smoking articles having the same design should be used. That is, a non-deformed un-smoked smoking article should be used for the pre-smoking deformation test, and non-deformed articles having the same design are subjected to the smoking test and used for the post-smoking deformation test.

To increase the resistance of the hollow tube segment to crushing, the filter preferably has an un-smoked compressive strength of at least about 20 Newtons at 50% compression. Alternatively, or in addition, the un-smoked compressive strength of the filter at 50% compression is preferably less than about 50 Newtons. The term "compressive strength" is a measure of the force required to provide a particular compression of the filter section of the smoking article. Compressive strength is measured using the compressive strength test described in detail below, where the compressive strength of a given smoking article design is the number average of the compressive strength measurements for a sample of ten smoking articles having the same design.

Where the smoking article includes a filter segment comprising one or more breakable capsules as described above, the ovality of the tube segment is preferably less than 35%, more preferably less than 30%, after a capsule crush test in which a force corresponding to the crush strength of the one or more capsules is applied to the smoking article. The crush strength of a capsule corresponds to the compressive force required to break open the capsule and release the additive contained within the capsule when the capsule is disposed within the filter segment. The capsule crush test is described in detail below.

Where the capsule crush test is performed after the smoking article has been subjected to a smoking test, the ovality of the tube segment is preferably less than about 45%, more preferably less than about 40%, after the capsule crush test.

The tipping wrapper may comprise paper having a basis weight of less than about 70 gsm, preferably less than about 50 gsm. The tipping wrapper preferably has a basis weight of more than about 20 gsm.

Smoking articles produced in accordance with the present invention may be filter cigarettes or other smoking articles in which the tobacco material is combusted to form smoke. Alternatively, the smoking articles may be articles in which the tobacco material is heated to form an aerosol, rather than combusted. In one type of heated smoking article, the tobacco material is heated by one or more electrical heating elements to produce an aerosol. In another type of heated smoking article, an aerosol is produced by the transfer of heat from a combustible or chemical heat source to a physically separate tobacco material, which may be located within, around or downstream of the heat source. The present invention further encompasses smoking articles in which a nicotine-containing aerosol is generated from a tobacco material without combustion or heating.

Test Procedures

Deformation and Compressive Strength Test

The smoking article to be tested is positioned between a flat surface and a circular plate opposed to the flat surface, the circular plate having a diameter of 10 mm. The edge of the circular plate closest to the mouth end of the smoking article is positioned 8 mm from the mouth end. The filter is then compressed by moving the circular plate towards the flat surface at a constant speed of 100 mm per second. The force applied by the circular plate is increased until the desired deformation of the portion of the smoking article between the circular plate and the flat surface is achieved. For example, to achieve a 50% deformation, the compressed portion of the smoking article is compressed to a diameter of 50% of the diameter of that portion prior to compression. Similarly, to achieve a 67% deformation, the smoking article is compressed until the compressed portion is reduced to a diameter of 33% of the diameter of that portion prior to compression. The diameter is measured in the direction of compression, which is the direction extending between the flat surface and the circular plate. Once the desired compression has been achieved, the force required to provide that compression is noted as the compressive strength of the filter. The circular plate is then retracted so that the compressive force is removed. The smoking article is left for 30 seconds to expand before any further tests or measurements are performed.

Smoking Test

To simulate the smoking of a smoking article, the smoking article is subjected to a standard smoking test under ISO conditions (35 ml puffs lasting 2 seconds each, every 60 seconds). In the ISO test method, the smoking article is smoked with the ventilation zone fully uncovered.

Capsule Crush Test

To perform a capsule crush test in accordance with the present invention, a smoking article including a breakable capsule is positioned between a lower plate having a diameter of 150 mm and an upper plate having a diameter of 20 mm. The portion of the smoking article housing the breakable capsule is positioned between the two plates such that the plates are centred on the location of the capsule. The smoking article and the capsule are then compressed by moving the upper plate towards the lower plate at a constant speed of 30 mm per minute. The force applied by the upper plate is increased until the capsule breaks, at which point the maximum compressive load applied by the upper plate is recorded as the crush strength of the capsule. The test is terminated when the maximum compressive load is reached and the upper plate is then retracted to remove the compressive force from the smoking article. The smoking article is left for 30 seconds to expand before any further tests or measurements are performed, such as ovality measurements.

The invention will now be further described, by way of example only, with reference to the accompanying drawings in which.

Figure 1:
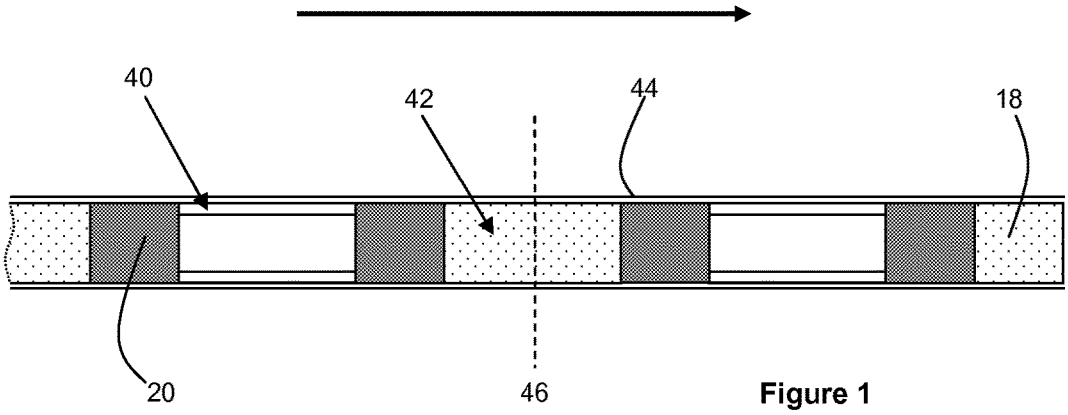
FIG. 1 shows a method of forming a plurality of smoking article filter rods, in accordance with the present invention.

FIG. 1 illustrates a process for forming a plurality of smoking article filter rods in accordance with the invention. A substantially continuous array of filter components is formed by providing a plurality of tubular members 40, a plurality of flavour containing filter segments 20 and a plurality of rod end filter members 42. A tubular member 40 is provided between each pair of consecutive rod end filter members 42, and a flavour containing filter segment 20 is provided between each rod end filter member 42 and each tubular member 40. The substantially continuous array of filter components is then wrapped in a continuous sheet of plug wrap 44 to form a wrapped filter array.

To form a plurality of filter rods, a plurality of first cuts 46 is made through at least some of the rod end filter members 42 of the wrapped filter array, each first cut 46 positioned at an intermediate position along the length of the respective rod end filter member 42. The resilience of each tubular member 40 advantageously prevents collapse of the cavities defined therein during the cutting process and subsequent handling of the filter rods and any smoking articles incorporating filters manufactured from the filter rods.

Figure 2:
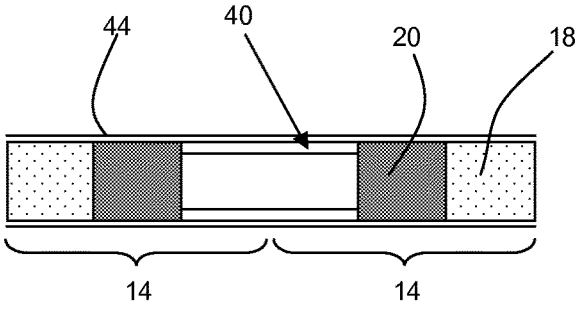
FIG. 2 shows a dual filter rod.

To form a dual filter rod, as shown in FIG. 2, the wrapped filter array is cut through each rod end filter member 42 so as to provide a filter rod having a rod end filter segment 18 at each end, two flavor containing filter segments 20 positioned between the two rod end filter segments 18, and a tubular member 40 positioned between the two flavor containing filter segments 20. The dual filter rod essentially defines two smoking article filters 14 which are joined by a continuous plug wrap 44 and a tubular member 40.

Figure 3:
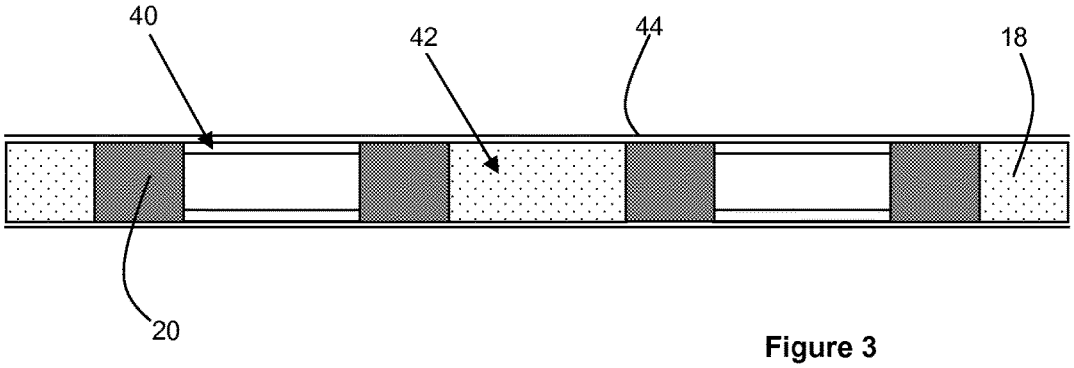
FIG. 3 shows a quadruple filter rod.

Alternatively, a quadruple filter rod, as shown in FIG. 3, can be formed by cutting the wrapped filter array through every other filter member 42 so as to provide a filter rod which essentially comprises two joined dual filter rods.

Figure 4:
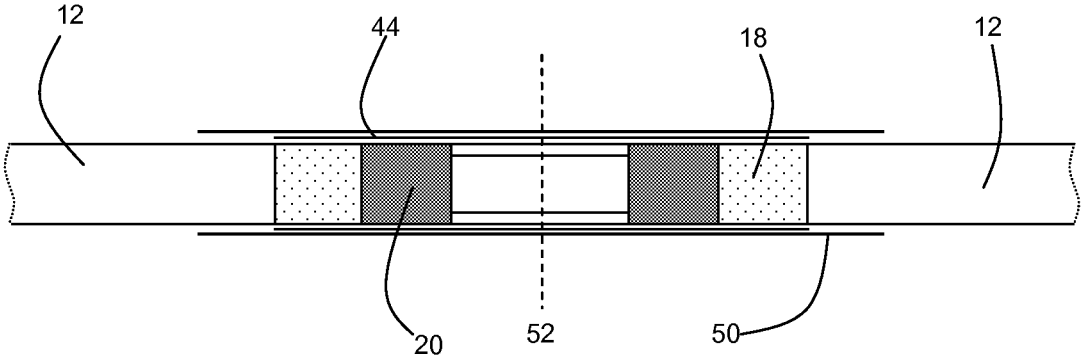
FIG. 4 shows an exemplary method of forming a smoking article using a dual filter rod, in accordance with the present invention.

The formed filter rods are used to form two or more smoking articles. For example, as shown in FIG. 4, a dual filter rod can be used to form two filter cigarettes 10 by placing a tobacco rod 12 in axial alignment with each end of the filter rod. A tipping wrapper 50 is then wrapped around the filter rod and a portion of each tobacco rod 12 adjacent the filter rod. The tipping wrapper 50, the plug wrap 44 and the tubular member 40 are then cut along a cut line 52 to form two filter cigarettes. The resilience of the tubular member 40 prevents collapse or deformation of the mouth end cavities of each cigarette 10 during the cutting process.

Figure 5:
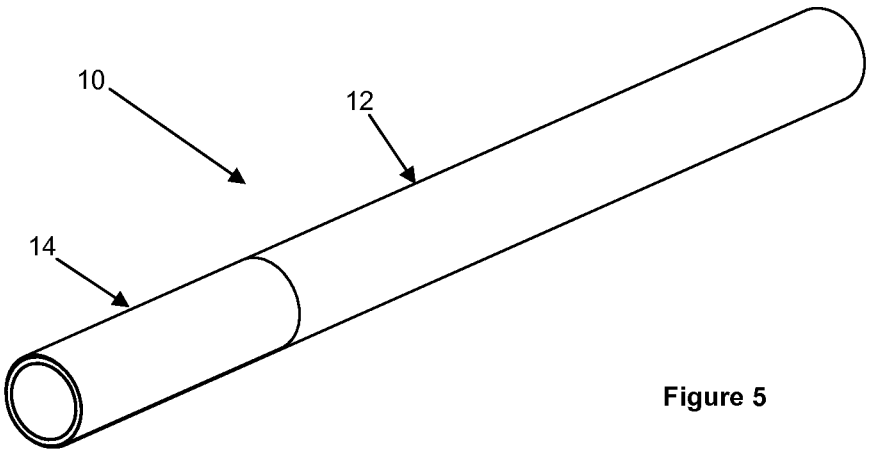
FIG. 5 shows a smoking article made in accordance with the method shown in FIG. 4.
Figure 6:
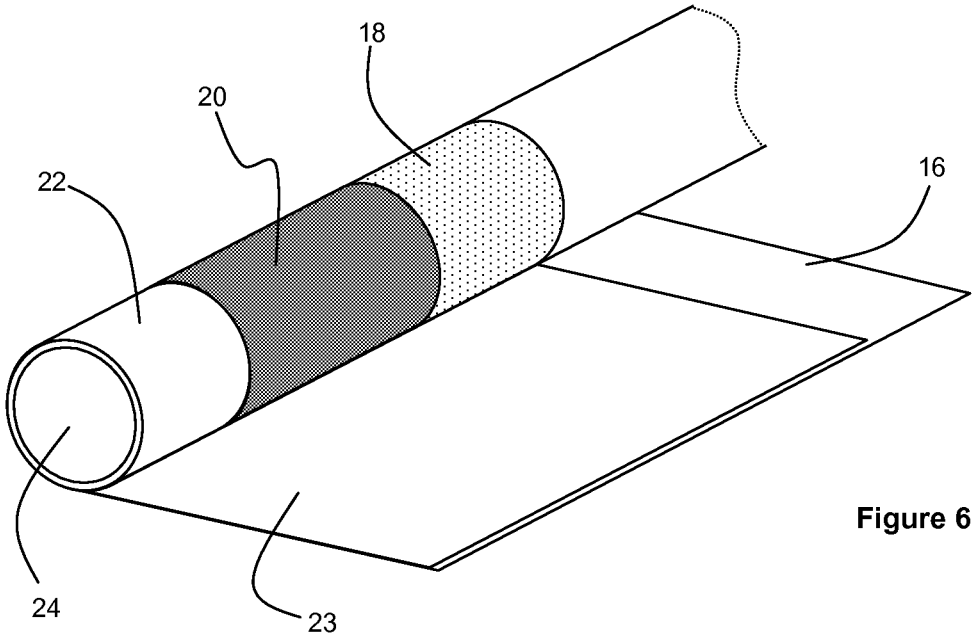
FIG. 6 shows the mouth end of the smoking article of FIG. 5 with the filter unwrapped.

As shown in FIGS. 5 and 6, each filter cigarette 10 comprises a wrapped rod 12 of tobacco cut filler which is attached at one end to an axially aligned filter 14. A tipping wrapper 16 formed from tipping wrapper 50 circumscribes the filter 14 and a portion of the wrapped rod 12 of tobacco to join together the two portions of the cigarette 10.

As shown in FIG. 6, the filter 14 comprises the rod end filter segment 18, the flavour containing filter segment 20, and a mouth end hollow tube segment 22 formed from part of a tubular member 40. The segments 18, 20 and 22 are circumscribed by a combining plug wrap 23 formed from the continuous sheet of plug wrap 44, the combining plug wrap 23 connecting the three segments to form the filter 14.

The rod end filter segment 18 and the flavour containing filter segment 20 are formed of a suitable filtration material, such as cellulose acetate tow. Furthermore, the flavour containing filter segment 20 comprises a suitable flavourant, which may be provided in the form of one or more breakable capsules contained within the flavour containing filter segment 20. In this case, the one or more breakable capsules are ruptured by the consumer when desired by squeezing the flavour containing filter segment 20 between the consumer's fingers.

The mouth end hollow tube segment 22 defines a mouth end cavity 24 in the filter 14 which extends between the downstream end of the flavour containing filter segment 20 and the mouth end edge of the filter 14. The mouth end hollow tube segment 22 provides sufficient mechanical strength and resilience to resist deformation of the mouth end cavity 24, for example during the rupture of the one or more breakable capsules when present in the flavour containing filter segment 20.

Figure 7:
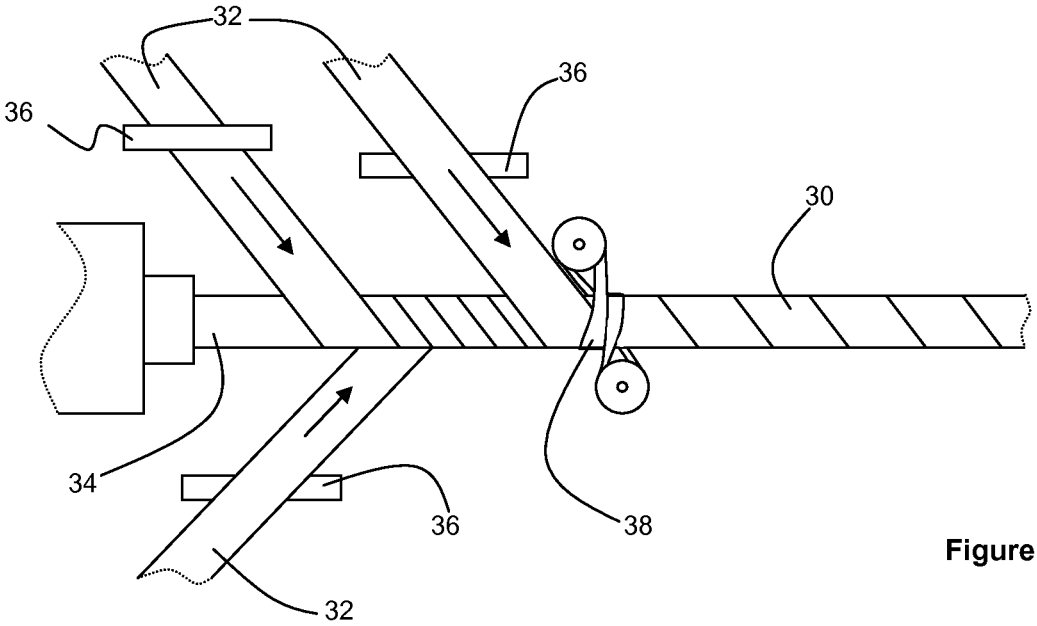
FIG. 7 shows an exemplary method of forming a tubular member.

FIG. 7 shows an exemplary method of forming a continuous tube 30 which can be cut to form a plurality of tubular members 40. To form the continuous tube 30, a plurality of continuous paper plies 32 are spirally wound around a cylindrical mandrel 34 in a staggered, overlapping arrangement. A suitable adhesive may be applied to one or more of the plies 32 using an adhesive bath 36 prior to winding each ply around the mandrel 34. The plies 32 are driven by a rubber belt 38 so that the continuous tube 30 rotates around the mandrel 34 until it is cut into desired lengths further downstream.

The invention claimed is:

1. A method of producing smoking articles, the method comprising the steps of:

providing a continuous array of first filter members, second filter segments and tubular members, wherein a tubular member is provided between each pair of consecutive first filter members, the tubular member being formed of a plurality of overlapping paper layers, wherein adjacent paper layers are adhered together by an intermediate layer of adhesive, and wherein a second filter segment is provided between each first filter member and each tubular member, wherein each tubular member has a length from 4 mm to 30 mm and a compressive strength at 50% compression from about 20 Newtons to about 50 Newtons, each second filter segment containing one or more breakable capsules, each breakable capsule comprising an outer shell and an inner core containing an additive;

wrapping the continuous array of first filter members, second filter segments and tubular members with a continuous sheet of plug wrap to form a wrapped filter array, wherein the plug wrap has a basis weight of less than 90 grams per square meter;

cutting the wrapped filter array at an intermediate position along each first filter member to provide multiple filter rods, each filter rod comprising two first filter segments, a tubular member positioned between the first filter segments and a second filter segment provided between each first filter segment and the tubular member;

providing a tobacco rod in axial alignment with and adjacent to each first filter segment of a filter rod;

wrapping the filter rod and a portion of each tobacco rod in a tipping wrapper; and cutting the tipping wrapper and the filter rod at an intermediate position along the length of the tubular member to form multiple smoking articles, each smoking article comprising a tobacco rod connected to a filter, wherein each filter comprises a first filter segment downstream of the tobacco rod, a second filter segment downstream of the first filter segment, and a hollow tube segment positioned between the second filter segment and the mouth end of the filter, the hollow tube segment defining a cavity at the mouth end of the filter.

2. A method according to claim 1, further comprising providing a segment plug wrap circumscribing each second filter segment, wherein each segment plug wrap is substantially impermeable to the additive in the inner core of the one or more breakable capsules.

3. A method according to claim 1, wherein the wall of each tubular member has a thickness of between 150 micrometers and 500 micrometers.

4. A method according to claim 1, wherein each tubular member comprises a coating layer on an inner surface thereof.

5. A method according to claim 2, wherein the wall of each tubular member has a thickness of between 150 micrometers and 500 micrometers.

6. A method according to claim 2, wherein each tubular member comprises a coating layer on an inner surface thereof.

7. A method according to claim 3, wherein each tubular member comprises a coating layer on an inner surface thereof.

8. A method according to claim 1, wherein the tipping wrapper has a basis weight of less than about 70 gsm.

* * * * *